US007022036B2

(12) United States Patent
DuFlon et al.

(10) Patent No.: US 7,022,036 B2
(45) Date of Patent: Apr. 4, 2006

(54) ELECTRONIC THROW-AND-CATCH GAME

(75) Inventors: Raymond H. DuFlon, Pescadero, CA (US); Phillip H. Neal, San Rafael, CA (US)

(73) Assignees: Prototoy LLC, Pescadero, CA (US); go products, Inc., Greenbrae, CA (US)

( * ) Notice: Subject to any disclaimer, the term of this patent is extended or adjusted under 35 U.S.C. 154(b) by 299 days.

(21) Appl. No.: 10/442,463

(22) Filed: May 21, 2003

(65) Prior Publication Data

US 2004/0235593 A1 Nov. 25, 2004

(51) Int. Cl.
*A63B 43/00* (2006.01)

(52) U.S. Cl. ..... 473/570; 473/571

(58) Field of Classification Search ..... 473/569–571, 473/614–615; 273/237, 444, 445–446, 454–455, 273/440; 446/34, 46, 47, 175; 463/7, 35–38
See application file for complete search history.

(56) References Cited

U.S. PATENT DOCUMENTS 3,304,650 A 2/1967 Glass et al.
4,770,416 A * 9/1988 Shimizu et al. ..... 463/9
4,817,952 A * 4/1989 Biro et al. ..... 273/153 S
4,890,838 A 1/1990 Rudell et al.
4,991,847 A 2/1991 Rudell et al.
5,066,011 A 11/1991 Dykstra et al.
5,288,069 A 2/1994 Matsumoto
5,445,375 A 8/1995 Sweeny
5,893,798 A * 4/1999 Stambolic et al. ..... 463/46
6,086,478 A * 7/2000 Klitsner et al. ..... 463/35
6,168,157 B1 * 1/2001 Beckman et al. ..... 273/237
6,210,278 B1 * 4/2001 Klitsner ..... 463/35

OTHER PUBLICATIONS

Instruction Sheet for TOP IT™ electronic game with bean-bag, Parker Brothers, © 1999 Hasbro, Pewtucket, RI 02862.

* cited by examiner

*Primary Examiner*—Xuan M. Thai
*Assistant Examiner*—Alex F. R. P. Rada, II
(74) *Attorney, Agent, or Firm*—Patent Law Offices of Michael E. Woods

(57) ABSTRACT

An electronic catch-and-throw game is disclosed that requires physical skill, logical thought, and advancing complexity in order to challenge players of all skill levels and hold their interest.

32 Claims, 18 Drawing Sheets

Power-up State

Wake-up State

Idle State

Game Start State

Game Throw State

Game Catch State

Game End State

Goodnight State

ELECTRONIC THROW-AND-CATCH GAME

BACKGROUND OF THE INVENTION

1. Field of the Invention

The present invention relates to the field of games. More particularly, the present invention relates to an apparatus and a method for a throw-and-catch game of elimination played by a single player or by multiple players.

2. Description of the Related Art

Apparatuses are well known for playing a game of throw-and-catch for one or more players.

A variety of articles have long been used for the simple game of catch. The object of this game is to throw the article and complete a catch without it dropping to the ground. Depending on the location and speed of the throw, the skill level required for a successful catch can become substantial but the activity is strictly physical and does not require much thought.

Various novel, easy-to-catch ball designs have been shown in the prior art. "KOOSH" type balls reduce the skill required for a successful catch by allowing the fingers to burrow into the material. Other designs use "VELCRO" type hook-and-loop fastening material on the ball and a catching surface causing the caught ball to stick on the surface, removing the need for timing the closure of the hand. These designs reduce the skill required for a successful game of throw-and-catch, making them more suitable for younger and less skilled players.

The addition of sound and lights to conventional balls is also well known. U.S. Pat. No. 5,066,011 to Dykstra discloses a ball with an enclosed flashtube and sound annunciator that are triggered when the ball is bounced. U.S. Pat. No. 5,288,069 to Matsumoto discloses a talking football that plays voice messages and sound effects when caught. Since these light and sound responses are triggered by simple bouncing or catching, and not by a specific and controllable action of the player, interest quickly diminishes.

Another well known throw-and-catch game is "hot potato". The object of this game is to pass an object between players and to not be holding the object when the time expires or the music stops. U.S. Pat. No. 3,304,650 to Glass discloses a toy bomb comprised of a mechanical timer and sounding device. U.S. Pat. Nos. 4,890,838 and 4,991,847, both to Rudell et al., disclose a timed water release toy comprised of a mechanical timer, liquid filled membrane, and an opening mechanism. Finally, U.S. Pat. No. 5,445,375 to Sweeney discloses a ball toy with an electronic timing device and a digitized voice module. The addition of a random time element to the simple game of catch increases the interest somewhat, but the required skill level is relatively low.

Another throw-and-catch game is "Top It"®, an electronic game manufactured by Hasbro, Inc. of Pawtucket, R I. The game is comprised of a hand-held device with three distinct catching areas and a passive bean-bag that is flipped into the air. When the game is played, a voice command directs the player flip the bag into the air and catch it in a specific catching area on the hand-held device. This game adds simple logic to the physical act of throw-and-catch, creating a more interesting game. Unfortunately, this game has only one bean bag to manipulate and only one hand of the player is involved which limits the number of possible moves and leads to boredom.

SUMMARY OF THE INVENTION

It is therefore an advantage of the present invention to have a throw-and-catch game that requires physical skill, logical thought, and advancing complexity in order to challenge players of all skill levels and hold their interest.

These and other advantages are accomplished by the present invention which in preferred embodiments relates to an electronic throw-and-catch game for one or more players. The game includes an electronic game device that is caught and thrown. The device identifies how it should be caught as or after it leaves the player's hands on a throw. Indication of the correct areas to touch during a catch can be a light display, sound effect, and/or voice command.

The game may be played by one player, throwing the electronic game device in the air, and catching it in the correct areas as indicated by the device. Alternatively, the game may be played by two or more players, with one player throwing the electronic game device to another player, and the other player catching the device in the correct areas as indicated by the device.

The device may operate in different modes. For example, in one mode, the device may repeat a pattern so that the players have an idea of where to catch the device from previous turns. In a second mode, the device may indicate different areas at which the device is to be caught in successive turns. Moreover, the device may operate at different levels, so that as the players get more proficient at the game, the game becomes more difficult, thereby maintaining the players' interest in the game.

BRIEF DESCRIPTION OF THE DRAWINGS

The invention will now be described with reference to the drawings. In the drawings, like reference characters are used for like parts throughout and closely related figures have the same number but different alphabetic suffixes.

DETAILED DESCRIPTION

Preferred embodiments of the present invention will now be described with respect to FIGS. 1–15, which relate to a throw-and-catch game that requires physical skill, logical thought, and advancing complexity in order to challenge players of all skill levels and hold their interest. The present invention may be embodied in many different forms and should not be construed as being limited to the embodiments set forth herein; rather these embodiments are provided so that this disclosure will be thorough and complete and will fully convey the invention to those skilled in the art. The invention is intended to cover alternatives, modifications and equivalents of these embodiments, which will be included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details. In other instances, well known methods, procedures, components, and circuits have not been described in detail as not to unnecessarily obscure aspects of the present invention.

Hardware

Figure 1:
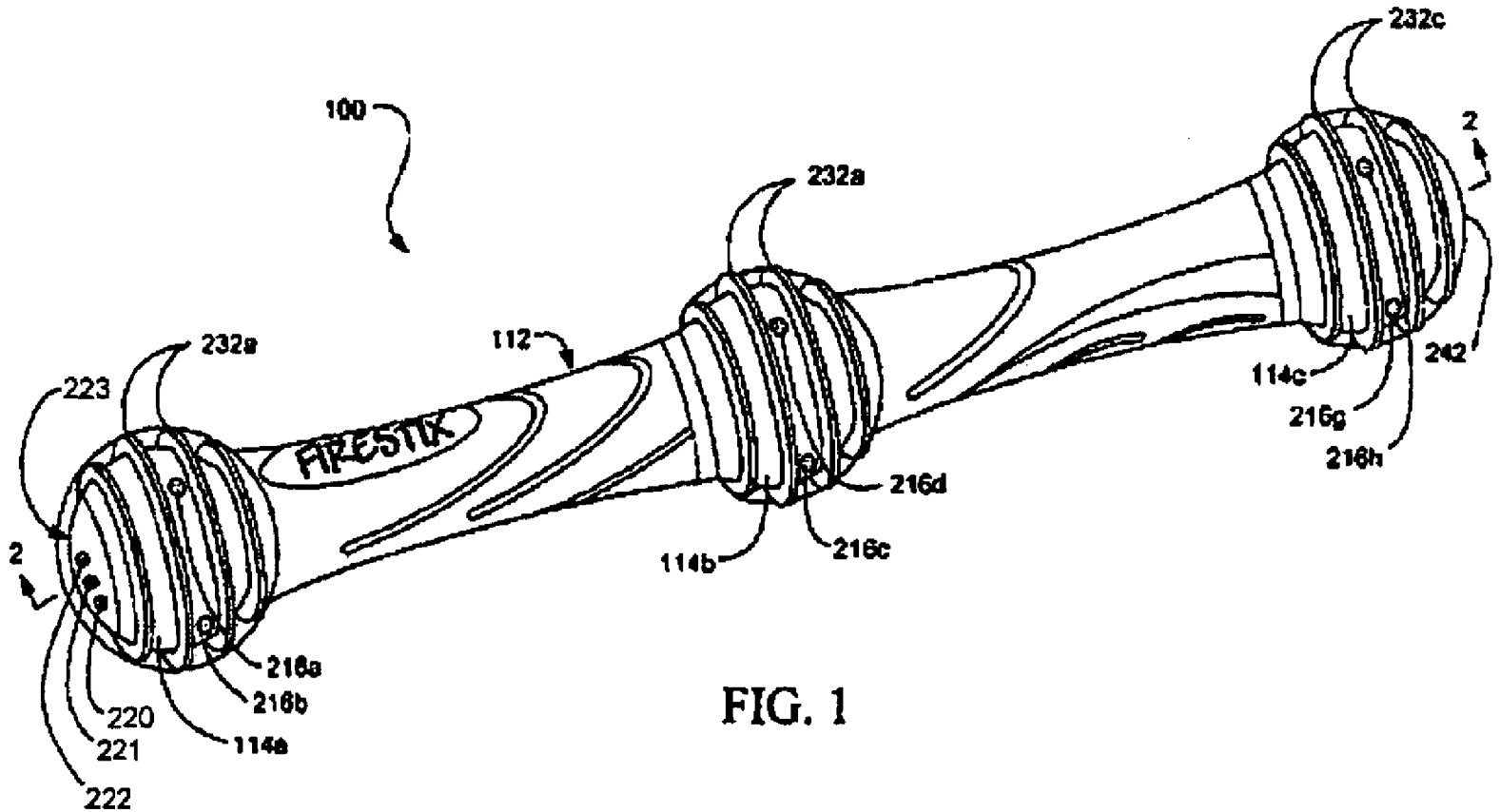
FIG. 1 is a perspective view of an electronic throw-and-catch game according to a first embodiment of the invention.

Referring to FIG. 1, an electronic game device 100 including a hollow tubular housing 112 is illustrated. The housing is preferably formed of a lightweight, durable material such as a variety of plastics. The housing 112 includes integral grip areas 114, and supports a control switch array 223 and a speaker 242. Each grip area 114 supports indicator 218 and touch rings 232. In one embodiment, the touch rings are made of a conductive material.

Figure 2:
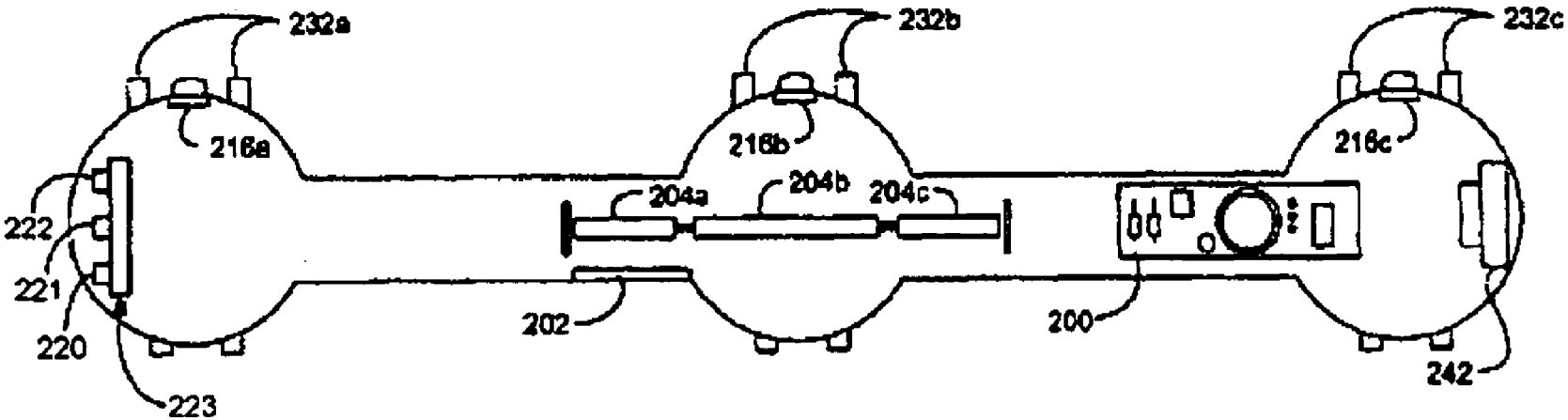
FIG. 2 is a partial cross sectional view taken along the line 2—2 in FIG. 1.

Referring now to FIG.2, the majority of the electronic components are contained on the printed circuit board 200. Access to user-replaceable battery cells 204 is provided through a battery door 202. It is understood the location of circuit board 200, battery cells 204 and battery door 202 within housing 112 may vary in alternative embodiments. Component mounting, screws, interconnecting wires, and other commonly-known details are provided but have been omitted from FIG. 2 for clarity.

Figure 3:
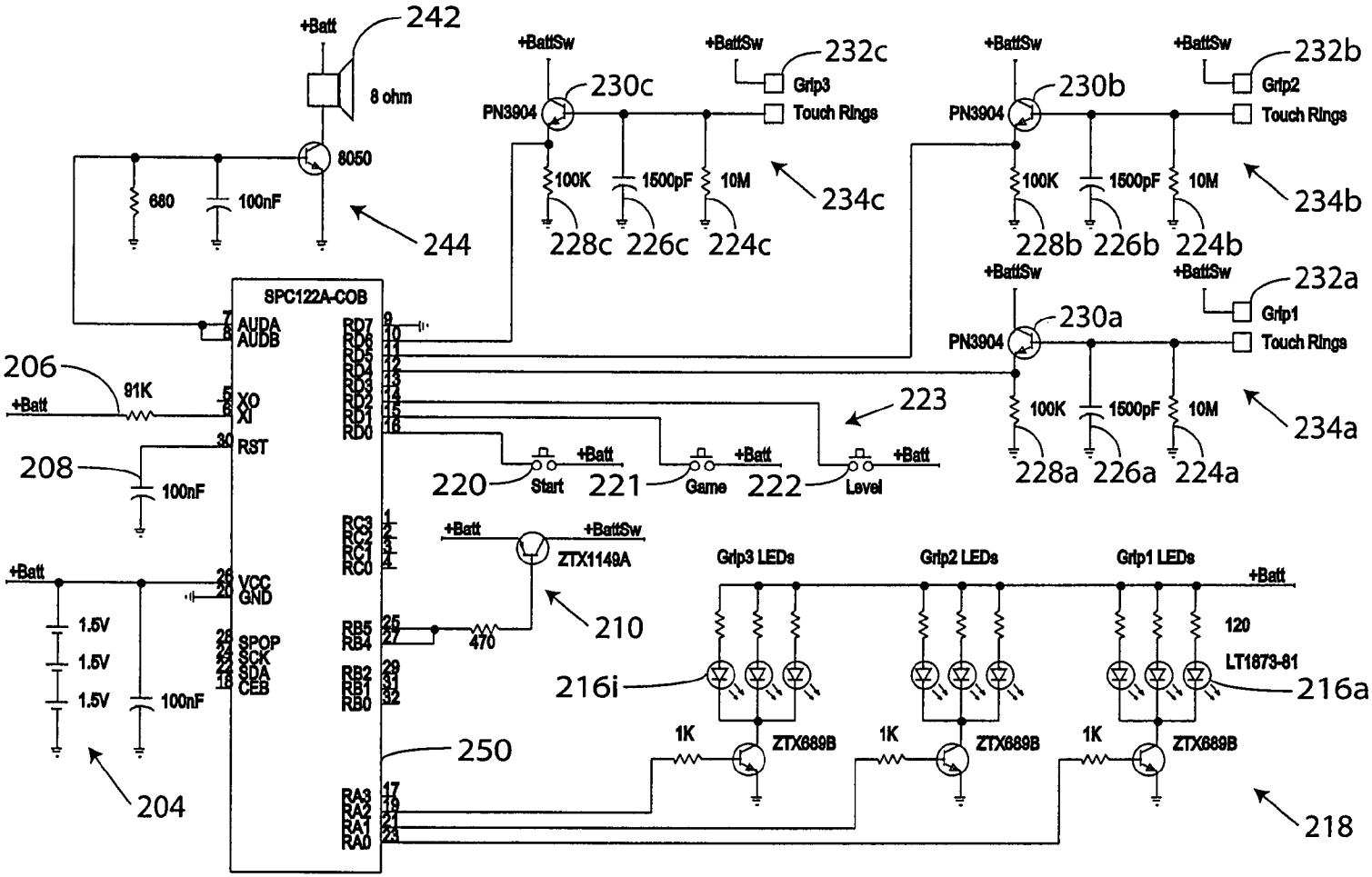
FIG. 3 is a detailed schematic diagram corresponding to the device of FIG. 1.

Referring now to the detailed circuit diagram of FIG. 3, a microprocessor 250 is used to read the control switch array 223 and grip touch sensor 234, control the indicator 218, and create sound effects and music that are amplified by a speaker driver 244 and played through the speaker 242. One suitable device for microprocessor 250 is the SPC122A-COB manufactured by Sunplus Technology Co., Ltd. of Hsin-Chu, Taiwan, R.O.C.

Power is supplied to the microprocessor and other circuitry by the battery cells 204. The microprocessor 250 contains an internal oscillator that uses frequency setting resistor 206 to determine its oscillation frequency. The indicated value of 91K ohms for this resistor nominally sets the frequency of oscillation to 3.57 MHz. although this value is not critical for proper operation. Reset capacitor 208 provides a power-up reset pulse for the microprocessor 250 upon application of power. When a game is not in play, the power to the grip touch sensor 234 may be turned off under program control using power control circuitry 210 in order to conserve power. The control switch array 223 provides game setup and initiation by the player and consists of start switch 220, game select switch 221, and level select switch 222.

The indicator 218 consists of multiple indicator LEDs 216 that provide visibility over a wide viewing angle and in high levels of ambient light. Other methods of indication are well known and may be utilized for indicator 218, including incandescent, electroluminescent, or fluorescent lamps or LCDs. Electromechanical indicators, including motor or solenoid driven indicators that rotate, extend, or retract a moveable element in order to expose an indicating color or pattern are also suitable.

Conductive touch sensing is used in the embodiment shown in FIGS. 1 through 3 for the grip touch sensor 234. Sensing is implemented by measuring current through the two touch rings 232 when a hand or other somewhat conductive medium is across them. The touch rings 232 are fabricated of a conductive material and enable sensing of a player's touch on that grip area 114. One material suitable for touch rings 232 is conductive rubber formed into an O-ring, although other materials and shapes may be utilized, including formed metal rings, ribs, two or more conductive contacts areas, and the like. The touch rings 232 connect to grip touch sensor 234 which consists of a transistor 230 and an emitter resistor 228 configured as an emitter follower, providing sufficient current gain to drive the microprocessor 250 input pin. An input pulldown resistor 224 and an input capacitor bias transistor 230 off and provide noise and ESD immunity.

Other methods of touch sensing may be utilized. One or more low actuation force switches may be used to directly sense a touch in the grip area 114, utilizing the weight of the electronic game device 100 to actuate the switch. Alternatively, the grip area 114 may consist of a flexible, sealed chamber whose pressure is monitored by a pressure switch. When grip area 114 is in contact with a hand or other surface and the weight of the electronic game device 100 is at least partially supported by the grip area 114, the increase in internal pressure actuates the switch. These and other methods of touch sensing are well known to those skilled in the art.

Proximity sensing may also be used to implement the grip touch sensor 234, since a hand that is close to grip area 114 may be assumed to be touching it without departing from the gameplay described herein. One well known method of proximity sensing utilizes the human body's pick-up of the ambient 50 Hz or 60 Hz power line field, couples it into a small sensing plate, and amplifies it to sense proximity. Another method is capacitive proximity sensing, which measures the capacitance across two or more plates. When a hand or other object is brought nearby, the increase in capacitance is sensed. Another method is electric field sensing, whereby a low level electric field is generated. Objects that are brought into the field change the loading, which is then measured. Still another method of proximity sensing is reflective optical sensing, where light from an emitter is reflected by a nearby object and sensed by an optical sensor. These and other methods of proximity sensing are well known to those skilled in the art and may be used in the present invention.

Software—General

Low level software routines that are well known by those skilled in the art will not be described herein. These routines, including sound play, switch debounce, and interrupt handling, are described in detail in the SPC Modules User Guide v1.0 published June 1998 by Sunplus Technology Co., Ltd., which reference is hereby incorporated by reference in its entirety herein.

The microprocessor 250 is programmed in the manner described in the OTP/MTP User Guide published on 24 Aug. 2000 by Sunplus Technology Co., Ltd. to perform the functions necessary to play the desired games. The OTP/MTP User Guide published on 24 Aug. 2000 by Sunplus Technology Co., Ltd is incorporated by reference in its entirety herein. Flowcharts illustrating the programming of the microprocessor 250 for the games particularly described herein are illustrated in FIGS. 4 through 8.

Software—Power-Up State 400

Figure 4:
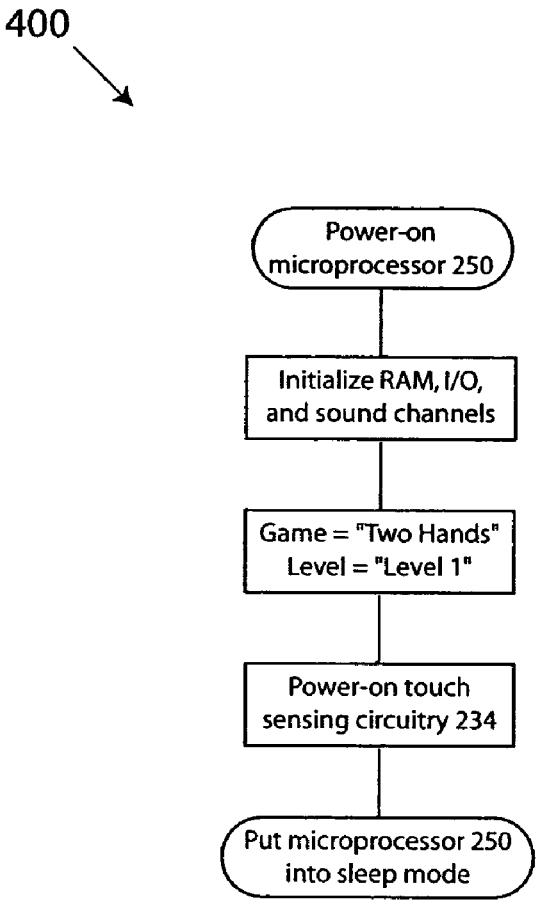
FIG. 4 is a flow chart illustrating operation of the device of FIG. 1 during the power-up state 400.

Referring now to FIG. 4, there is shown a flowchart for the power-up state 400 of the present invention. The power-up state 400 occurs when batteries are inserted into the unit. RAM, IO, and sound channels are initialized, and the touch sensing circuitry is powered on. Game selection is initialized, for example, to "Two Hands" and Level selection is initialized, for example, to "Level 1". The code in this state executes only once, after which control is passed to the idle state 600.

Software—Wake-Up State 500

Figure 5:
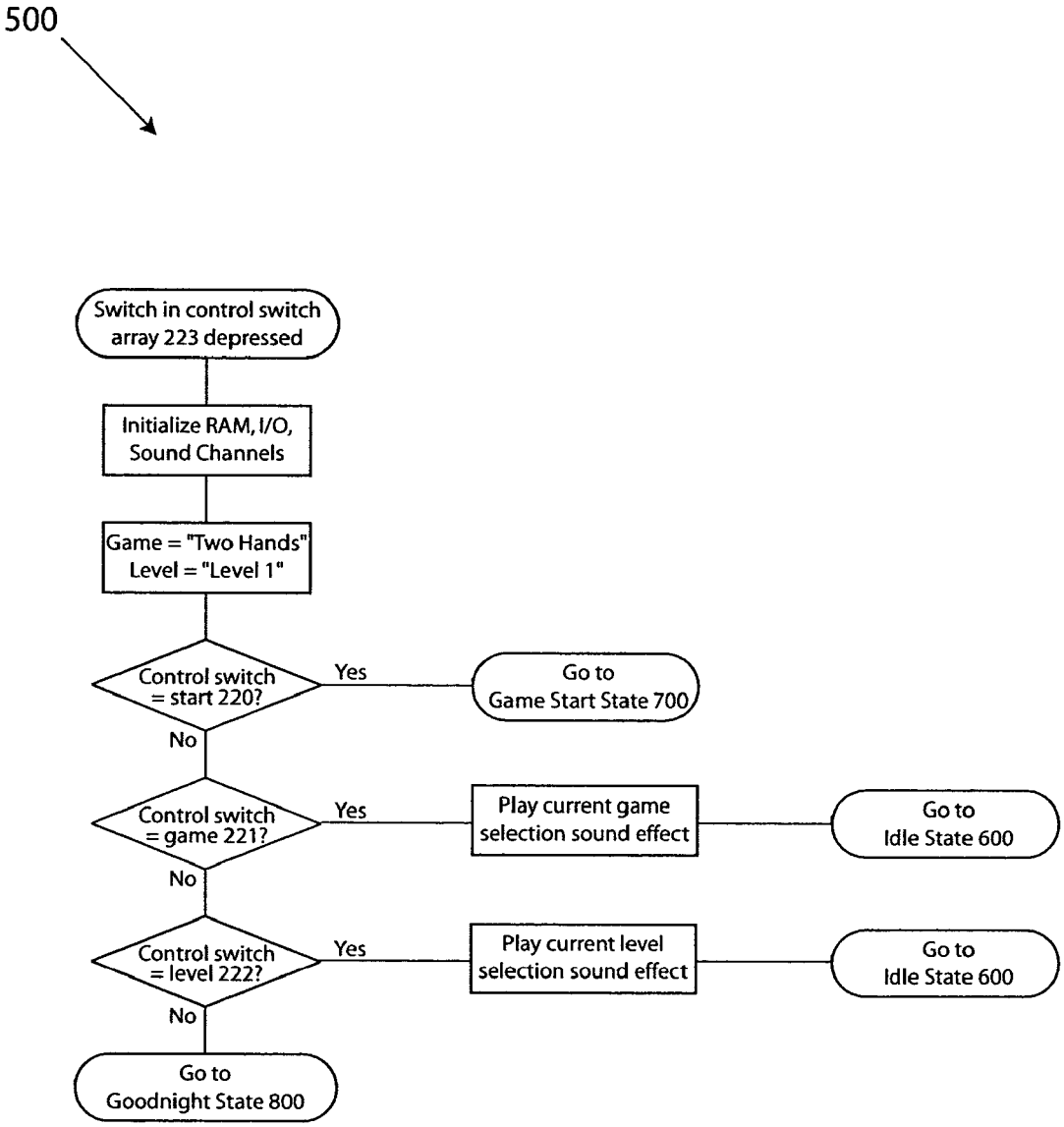
FIG. 5 is a flow chart illustrating operation of the device of FIG. 1 during the wake-up state 500.

Referring now to FIG. 5, there is shown a flowchart for the wake-up state 500 of the present invention.

The wake-up state 500 occurs when any switch in the control switch array 223 is depressed while the microprocessor is in sleeping. RAM, IO, and sound channels are initialized, and the touch sensing circuitry is powered on. Game selection is initialized, for example, to "Two Hands" and Level selection is initialized, for example, to "Level 1". The code in this state executes only once.

If the start switch 220 initiated the wake-up, control is passed to the Game state 700 and a game is immediately started at the initial game and level selection.

If the game select switch 221 initiated the wake-up, a short sound effect representing the initial game selection is played and control is passed to the idle state 600.

If the level select switch 222 initiated the wake-up, a short sound effect representing the initial level selection is played and control is passed to the idle state 600.

If none of the switches in the control switch array 223 are found to be closed, a spurious switch event is assumed and control is passed to the goodnight state 800.

Software—Idle State 600

Figure 6:
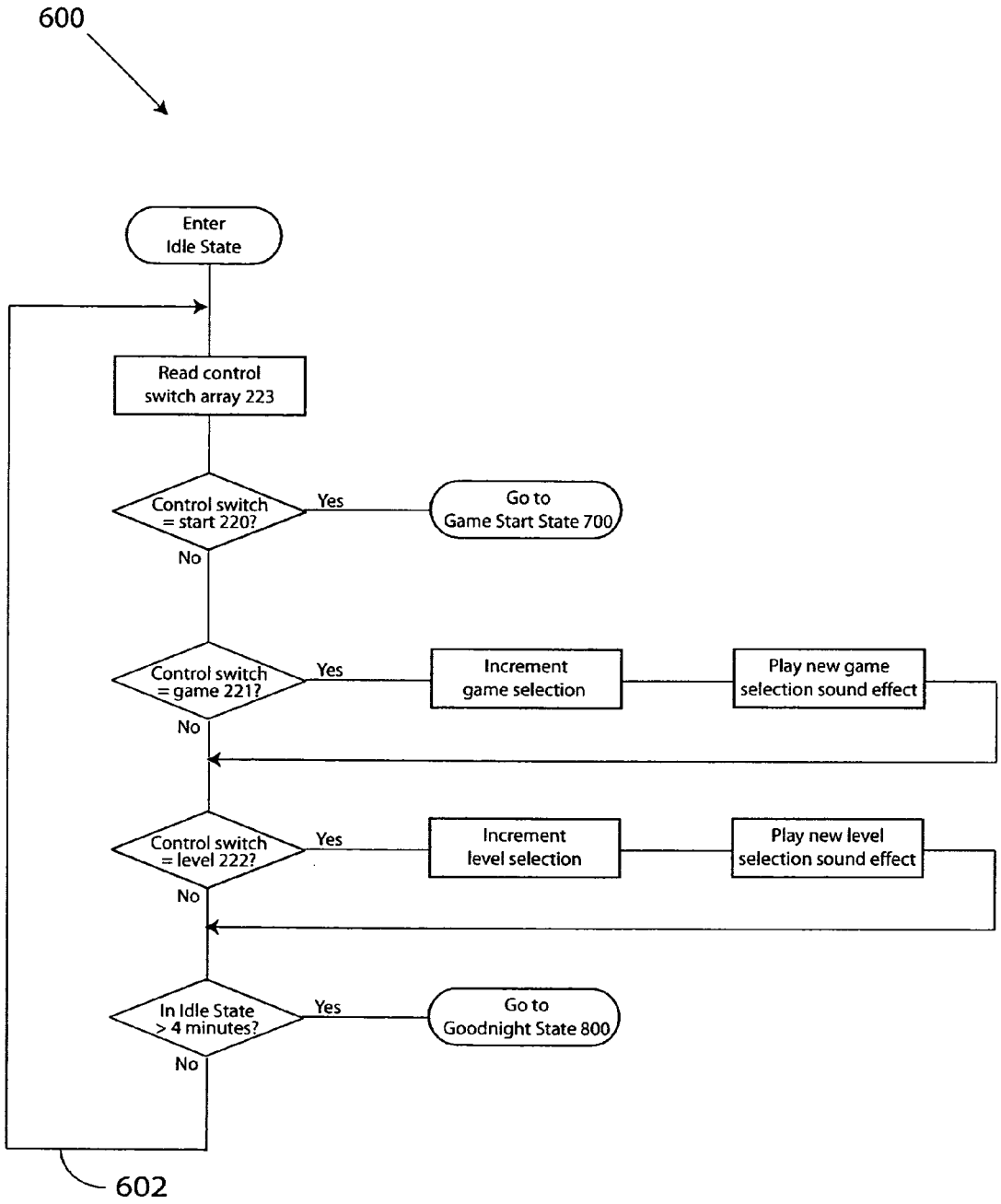
FIG. 6 is a flow chart illustrating operation of the device of FIG. 1 during the idle state 600.

Referring now to FIG. 6, there is shown a flowchart for the idle state 600 of the present invention.

If the start switch 220 is closed, control is passed to the game start state 700 and a game is immediately started at the current game and level selection.

If the game select switch 221 is closed, the game selection is advanced to the next available game and a short sound effect representing the new selection is played. Available game selections are "Two Hands", "One Hand", and "Practice", and will be described in detail below.

If the level select switch 222 is closed, the level selection is advanced to the next available level and a short sound effect representing the new selection is played. Available level selections are "Level 1", "Level 2", "Level 3", and "Level 4", and will be described in detail below. It is understood that the present invention may have more or less than four levels in alternative embodiments.

If the microprocessor 250 has been in the idle state 600 for more than two minutes, the game is considered abandoned and control is passed to the goodnight state 800, otherwise idle loop 602 repeats the process described.

Software—Game States

Figure 7A:
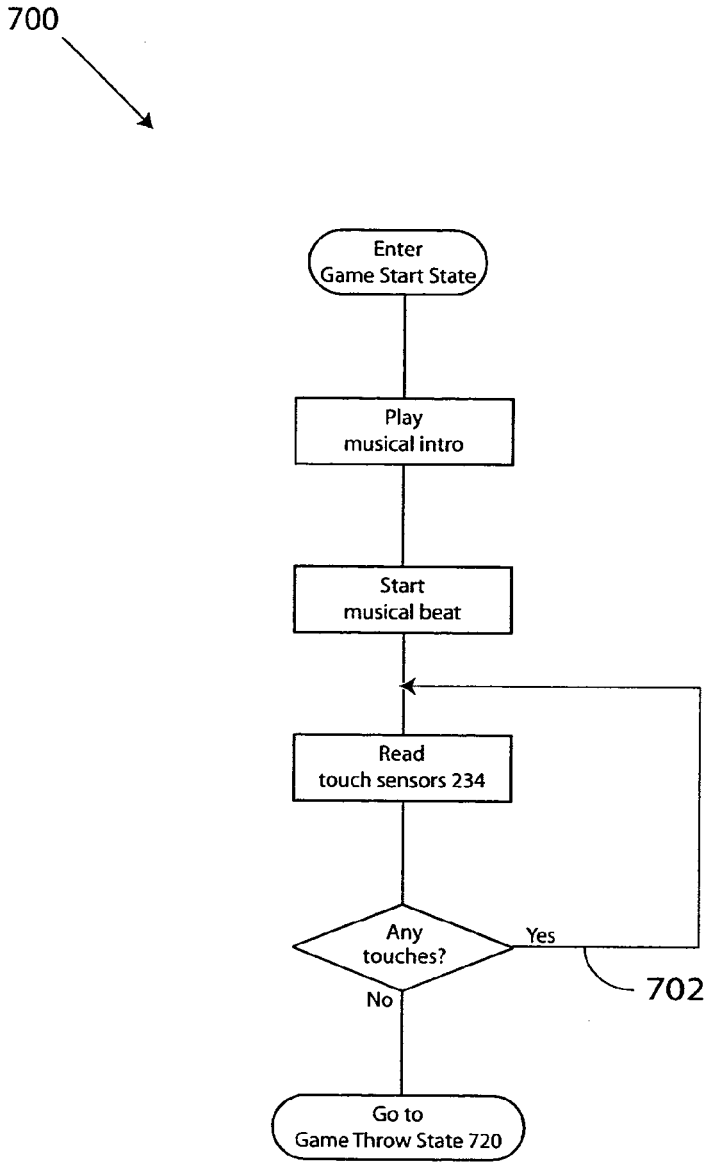
FIG. 7*a* is a flow chart illustrating operation of the device of FIG. 1 during a game start state 700.

Referring now to FIG. 7*a*, there is shown a flowchart for the game start state 700 of the present invention.

The start of a new game preferably begins with the playing of a musical intro sound sample. As soon as the intro has finished playing, the musical beat sound sample is started. The musical beat continues to play during the entirety of the game.

The grip touch sensors 234 are read and checked for any touches. If one or more sensors are active, loop 702 holds control. If no sensors are active, then the electronic game device 100 is not being touched at any of the grip areas 114, indicating that the device has left the player's hands and has been thrown. Accordingly, control is passed to game throw state 720.

Figure 7B:
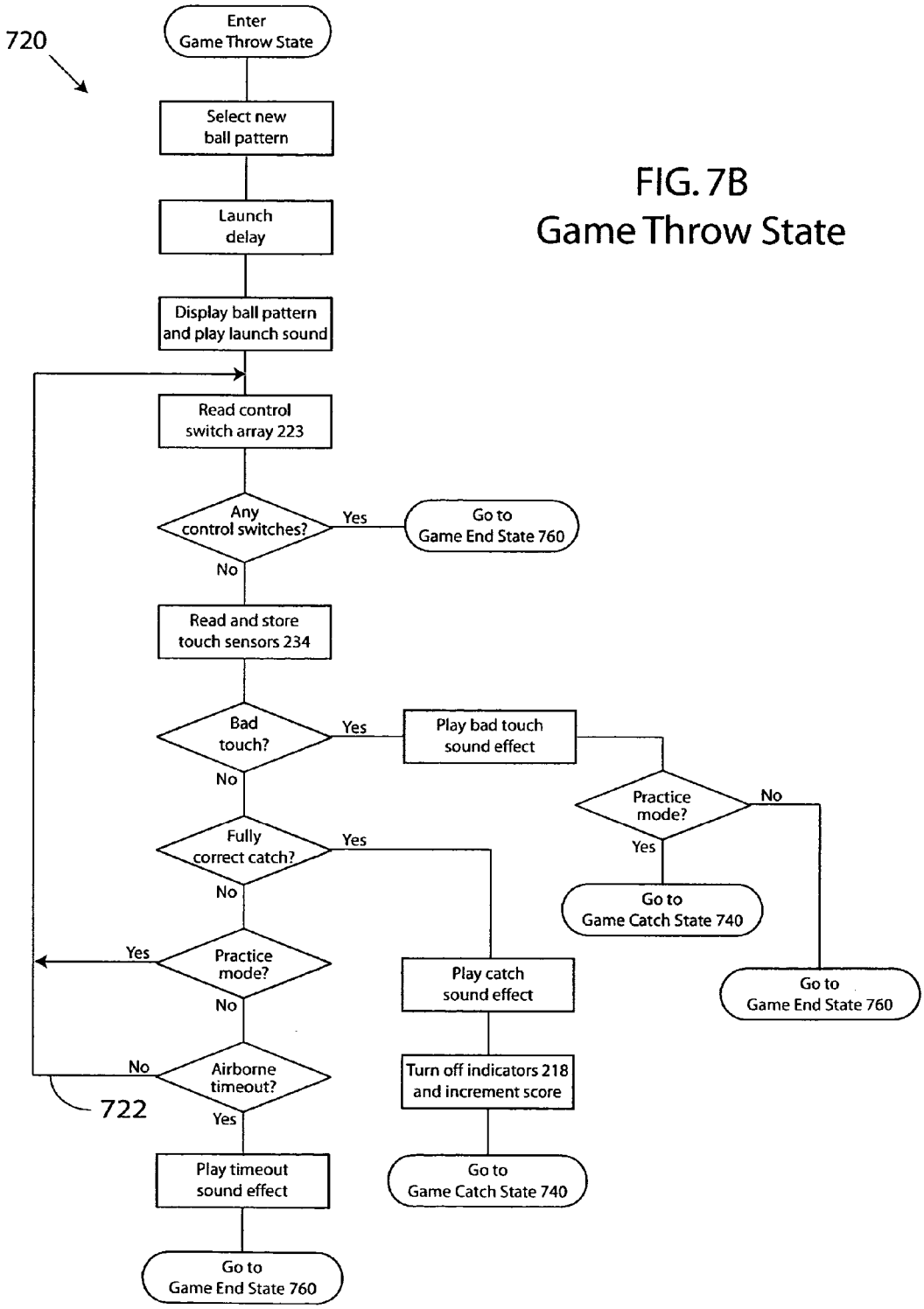
FIG. 7*b* is a flow chart illustrating operation of the device of FIG. 1 during a game throw state 720.

Referring now to FIG. 7*b*, there is shown a flowchart for the game throw state 720 of the present invention.

In one embodiment of the present invention, in game throw state 720, a new grip pattern is randomly selected with a probability that depends on which one of the three games is being played and at what level (see Tables 1a., 1b., and 1c below). This grip pattern is stored for display as well as response checking.

In the following tables, the words "left," "center" and "right" under the LED-illuminated grip patterns represent left grip area 114*a*, the middle grip area 114*b* and the right grip area 114*c*, respectively. Thus, for example, the Table 1a shows at level three that there is a 25% chance of the left and right grip areas 114*a*, 114*c* being illuminated; there is a 25% chance of the left and middle grip areas 1 14*a*, 114*b* being illuminated; there is a 25% chance of just the middle grip area 114*b* being illuminated; and there is a 25% chance of the middle and right grip areas 114*b*, 114*c* being illuminated. Some of the grip patterns require contact with each of the left, right and center grip areas. This may be accomplished, for example, by a player catching the device at the left and right grip areas with his or her hands, and contacting the middle grip area with a knee or forehead or other body part.

TABLE 1a

Pattern Probability (Two Hands)

| Level | Grip Patterns | Probabilities |
|---|---|---|
| 1 | left & right, middle | Alternating |
| 2 | left & middle, middle & right | Alternating |
| 3 | left & right, left & middle, middle, middle & right | 25%, 25%, 25%, 25% |
| 4 | left, left & middle, left & right, middle, middle & right, right, left & middle & right | 18.75%, 18.75%, 12.5%, 6.25%, 18.75%, 18.75%, 6.25% |

TABLE 1b

| Pattern Probability (One Hand) | | |
|---|---|---|
| Level | Grip Patterns | Probabilities |
| 1 | middle | Always |
| 2 | right, left | Alternating |
| 3 | left, middle, right | 37.5%, 25%, 37.5% |
| 4 | left, middle, right | 37.5%, 25%, 37.5% |

TABLE 1c

| Pattern Probability (Practice) | | |
|---|---|---|
| Level | Grip Patterns | Probabilities |
| 1 | left & right, middle | Alternating |
| 2 | left & middle, middle & right | Alternating |
| 3 | left & right, left & middle, middle, middle & right | 25%, 25%, 25%, 25% |
| 4 | left, left & middle, left & right, middle, middle & right, right, left & middle & right | 18.75%, 18.75%, 12.5%, 6.25%, 18.75%, 18.75%, 6.25% |

After the grip pattern selection is made, a launch delay of 100 milliseconds is provided. This provides a perceivable delay to help the player clearly separate a previously completed move from the new pattern. As discussed in the Alternative Embodiments section below, the launch delay time may be decreased or increased, or a fictitious grip pattern may be momentarily displayed during this time, depending on the catch difficulty desired.

After the launch delay completes, the new grip pattern is displayed on the indicators 218 and a launch sound effect is played. It is at this instant that the player discovers which grip areas 114 are to be touched and which are to be avoided.

The control switch array 223 is read. If any control switch is depressed, the played is manually indicating that the game should end now and control is passed to game end state 760.

The grip touch sensors 234 are now read and stored. If one or more of the grip touch sensors 234 indicate a touch of a grip area 114 that is not illuminated, a bad touch sound effect is immediately played to notify the player. If the current game is Practice, the bad touch is ignored and control passes to game catch state 740, otherwise control passes to game end state 760.

If the stored state of the grip touch sensors 234 indicate an exact match with the current grip pattern selection, a fully correct catch has been made. The catch sound effect is played, the indicators 218 are turned off, the score count is incremented, and control is passed to game catch state 740.

If an exact match has not been made and the current game is Practice, loop 722 returns to the control switch array 223 read. If the current game is not Practice, the airborne time is compared to the limit value shown in Table 2. If the limit has not yet been reached, loop 722 returns to the control switch array 223 read. If the limit has been reached, the timeout sound effect is played and control passes to game end state 760. It is easily understood that the airborne alarm time values shown can be increased or decreased to adjust difficulty as desired.

TABLE 2

| Airborne Limit Time | |
|---|---|
| Level | Alarm Time (S) |
| 1 | 1.65 |
| 2 | 1.56 |
| 3 | 1.46 |
| 4 | 1.37 |

Figure 7C:
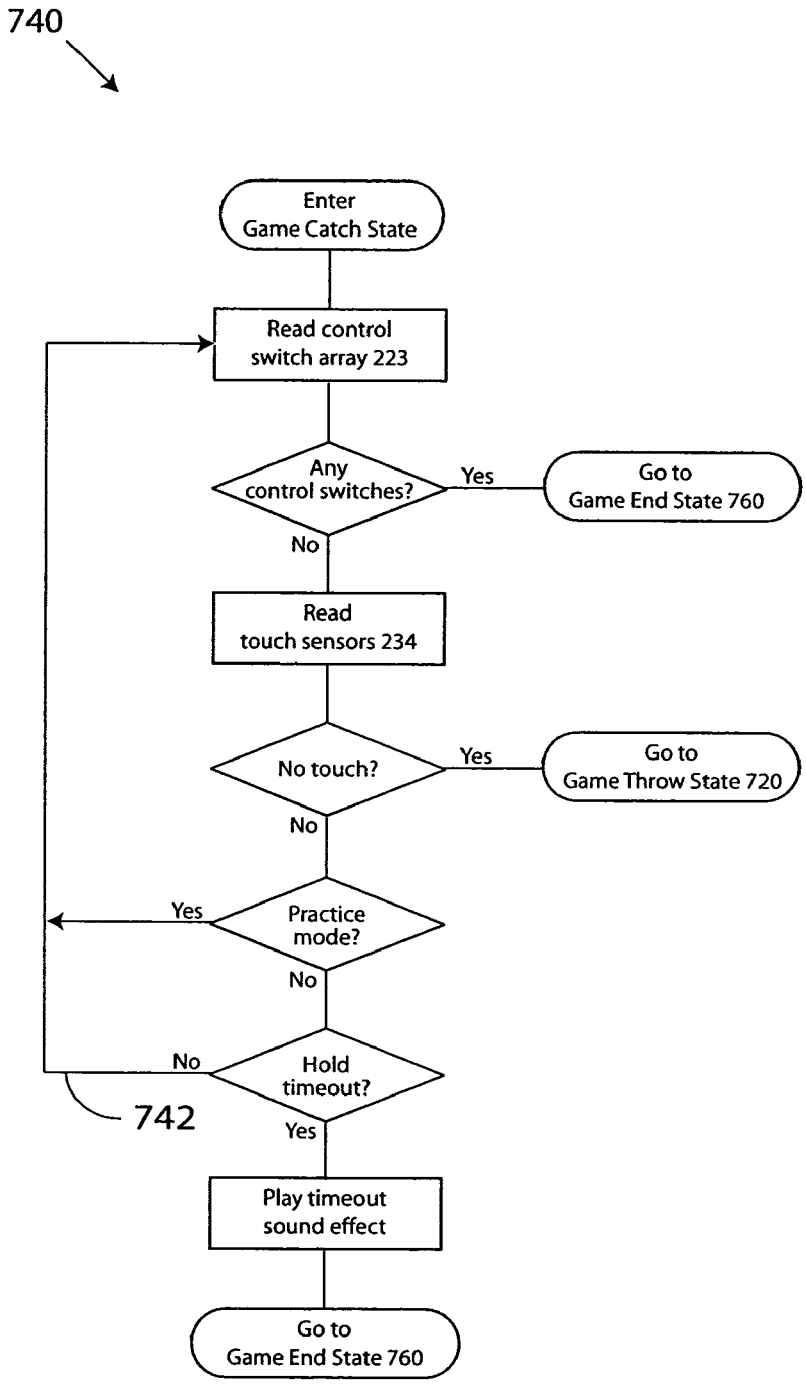
FIG. 7*c* is a flow chart illustrating operation of the device of FIG. 1 during a game catch state 740.

Referring now to FIG. 7*c*, there is shown a flowchart for the game catch state 740 of the present invention.

The control switch array 223 is read. If any control switch is depressed, the player is manually indicating that the game should end now and control is passed to game end state 760.

The grip touch sensors 234 are now read. If none of the grip touch sensors 234 indicate a touch of a grip area 114, a new throw is starting and control passes to the game throw state 720.

If one or more touches are present and the current game is Practice, loop 742 returns to the control switch array 223 read. If the current game is not Practice, the hold time is compared to the limit value shown in Table 3. If the limit has not yet been reached, loop 742 returns to the control switch array 223 read. If the limit has been reached, the timeout sound effect is played and control passes to game end state 760. It is easily understood that the hold alarm time values shown can be increased or decreased to adjust difficulty as desired.

TABLE 3

| Hold Limit Time | |
|---|---|
| Level | Alarm Time (S) |
| 1 | 1.65 |
| 2 | 1.56 |
| 3 | 1.46 |
| 4 | 1.37 |

Figure 7D:
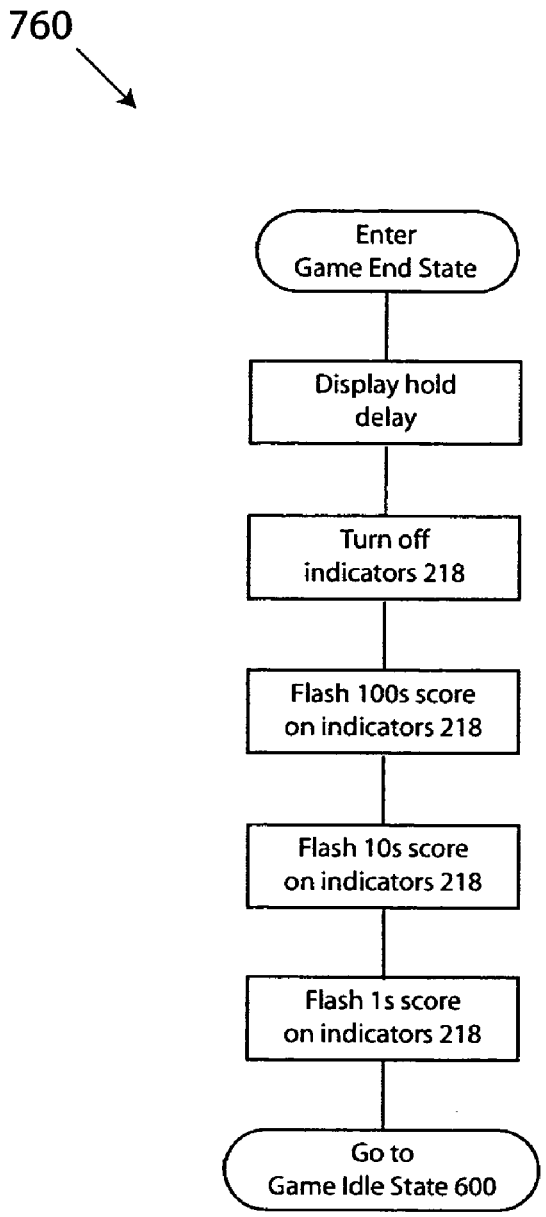
FIG. 7*d* is a flow chart illustrating operation of the device of FIG. 1 during a game end state 760.

Referring now to FIG. 7*d*, there is shown a flowchart for the game end state 760 of the present invention.

A display hold delay of 1 second is provided to allow the observation of the indicators 218 in the case of a bad move. This provides feedback for player improvement. The display hold delay period may be greater or less than 1 second in alternative embodiments.

The indicators 218 are then turned off and the score count is sequentially displayed. In the preferred embodiment with three grip areas, the leftmost grip represents the hundreds portion of the score, the middle grip represents the tens portion of the score, and the right grip represents the ones portion of the score. For example, if the score (number of successfully completed catches) was 123, the left grip flashes once, the middle grip flashes twice, and the right grip flashes three times. Simultaneous with each flash a short sound effect is played to reinforce the flash. When the score display has completed, control passes to idle state 600. As would be appreciated by those of skill in the art, the score may alternatively be displayed numerically on a display screen provided somewhere along the housing 112.

Software—Goodnight State 800

Figure 8:
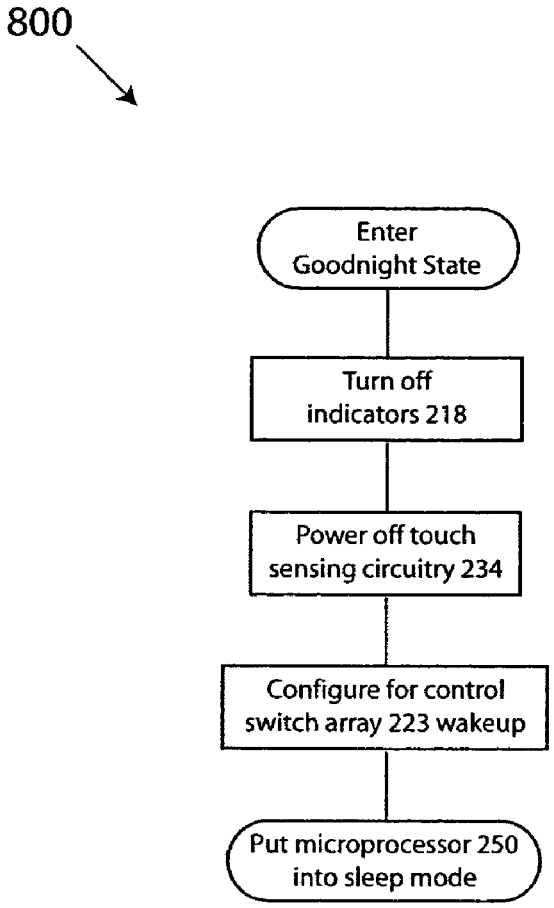
FIG. 8 is a flow chart illustrating operation of the device of FIG. 1 during a goodnight state 800.

Referring now to FIG. 8, there is shown a flowchart for the goodnight state 800 of the present invention.

If there are no changes in the Ball Touch Sensors or UI switches for 2 minutes, it is assumed that the unit has been abandoned and it is time to go to sleep. Tasks before sleep include discontinuing sound play if active, turning off all Ball LEDs, and turning off power to the audio amplifier and touch sensing circuitry. Finally the microprocessor is configured for wakeup on any UI Switch closure and is put into sleep mode. Note that the idle timer is a main loop task that is active any time the unit is awake.

Additional Embodiments

Figure 9:
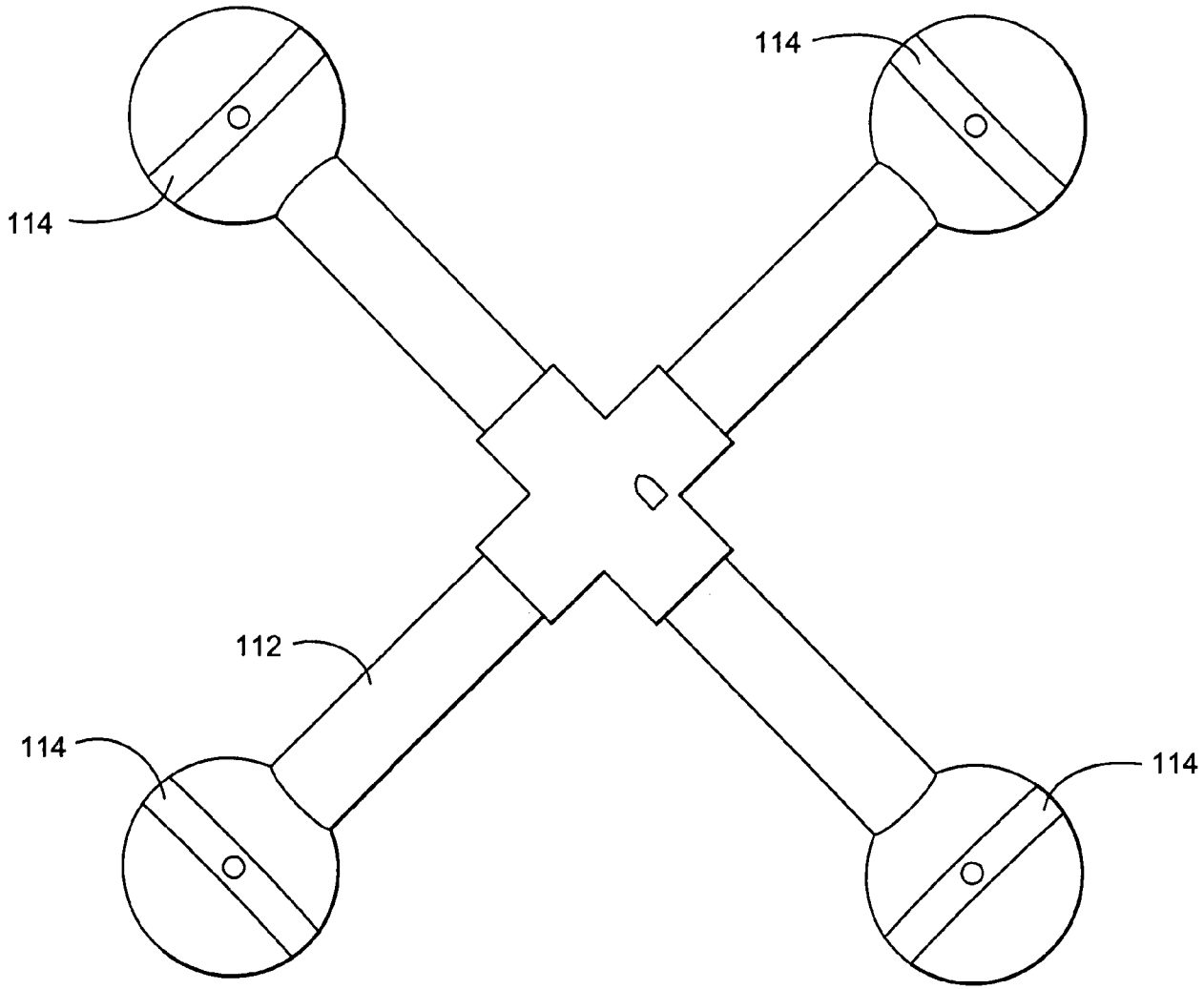
FIG. 9 is a perspective view of a two-axis electronic throw-and-catch game with four grip areas according to a first additional embodiment of the invention.

In FIG. 9, an X-shaped, or two axis, housing 112 provides four grip areas 114 according to a first additional embodiment of the invention. The two axes of the housing are preferably orthogonal to each other, but may be otherwise in alternative embodiments. This shape increases throw and catch difficulty due to its non-linear grip area 114 arrangement. This additional difficulty can be somewhat reduced by programming a high percentage of two hand grip patterns that illuminate grip areas 114 that are directly opposite from each other for the lower game levels. Many players find that opposites are more easily thrown and caught.

Figure 10:
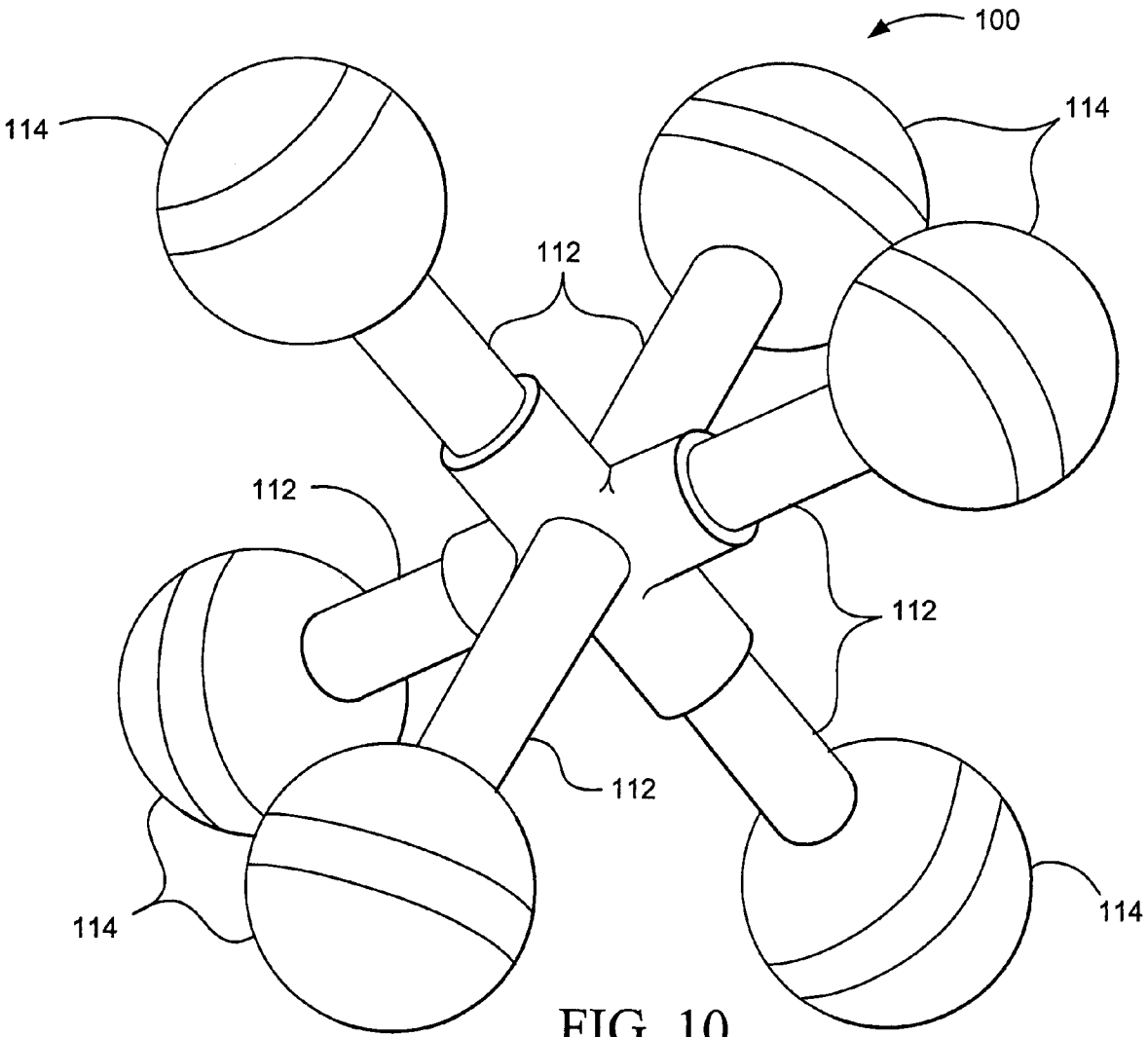
FIG. 10 is a perspective view of a three-axis electronic throw-and-catch game with six grip areas according to a second additional embodiment of the invention.

In FIG. 10, a jack-shaped, or three axis, housing 112 provides six grip areas 114 according to a second additional embodiment of the invention. Each of the three axes of the housing are preferably orthogonal to each other axis, but may be otherwise in alternative embodiments. Throw and catch difficulty is further increased, making this design suitable for players looking for a greater challenge.

Figure 11:
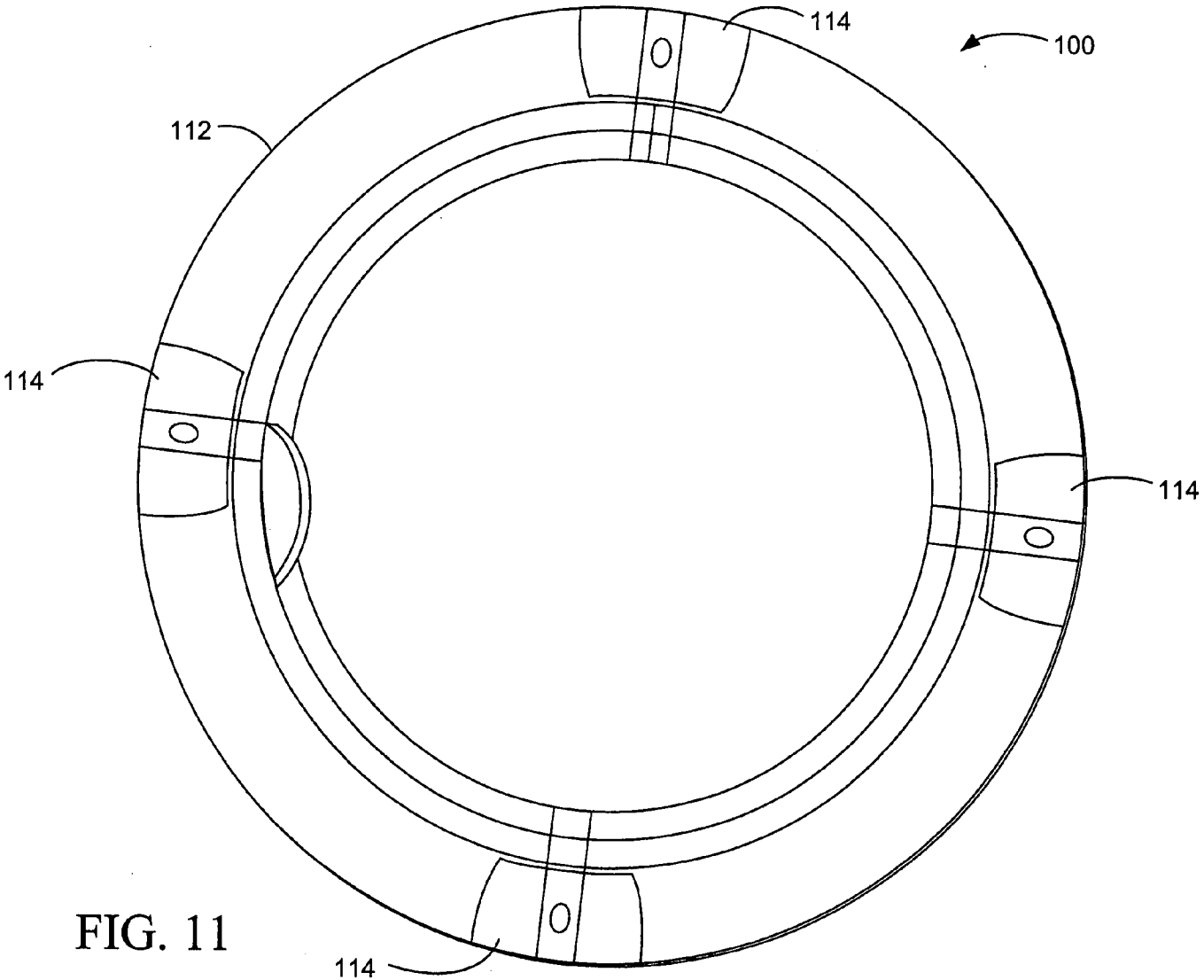
FIG. 11 is a perspective view of a ring-shaped electronic throw-and-catch game with four grip areas according to a third additional embodiment of the invention.

In FIG. 11, a ring-shaped housing 112 with four grip areas 114 is shown according to a third additional embodiment of the invention. As can be easily understood, a range of the number of grip areas 114 exists depending on the desired diameter of the housing 112, the desired width of the grip area 114, and the desired spacing between grip areas 114.

In a further alternative embodiment (not shown), the ring-shaped electronic toy device 100 shown in FIG. 11 could alternatively or additionally include sensors 234 around an inner periphery of the ring. In accordance with this embodiment, part of the game could require a player to catch the ring on his/her arm (i.e., through the center of the ring). In this embodiment, when correctly caught, none of the grip areas 114 would indicate contact, but one or more of the sensors 234 on the interior of the ring would indicate contact.

In a further alternative embodiment where the device 100 comprises a ring, the game could be played by spinning the ring when thrown around an axis of rotation of the ring. The player(s) would have to catch any switch on the spinning device to complete the move.

Figure 12:
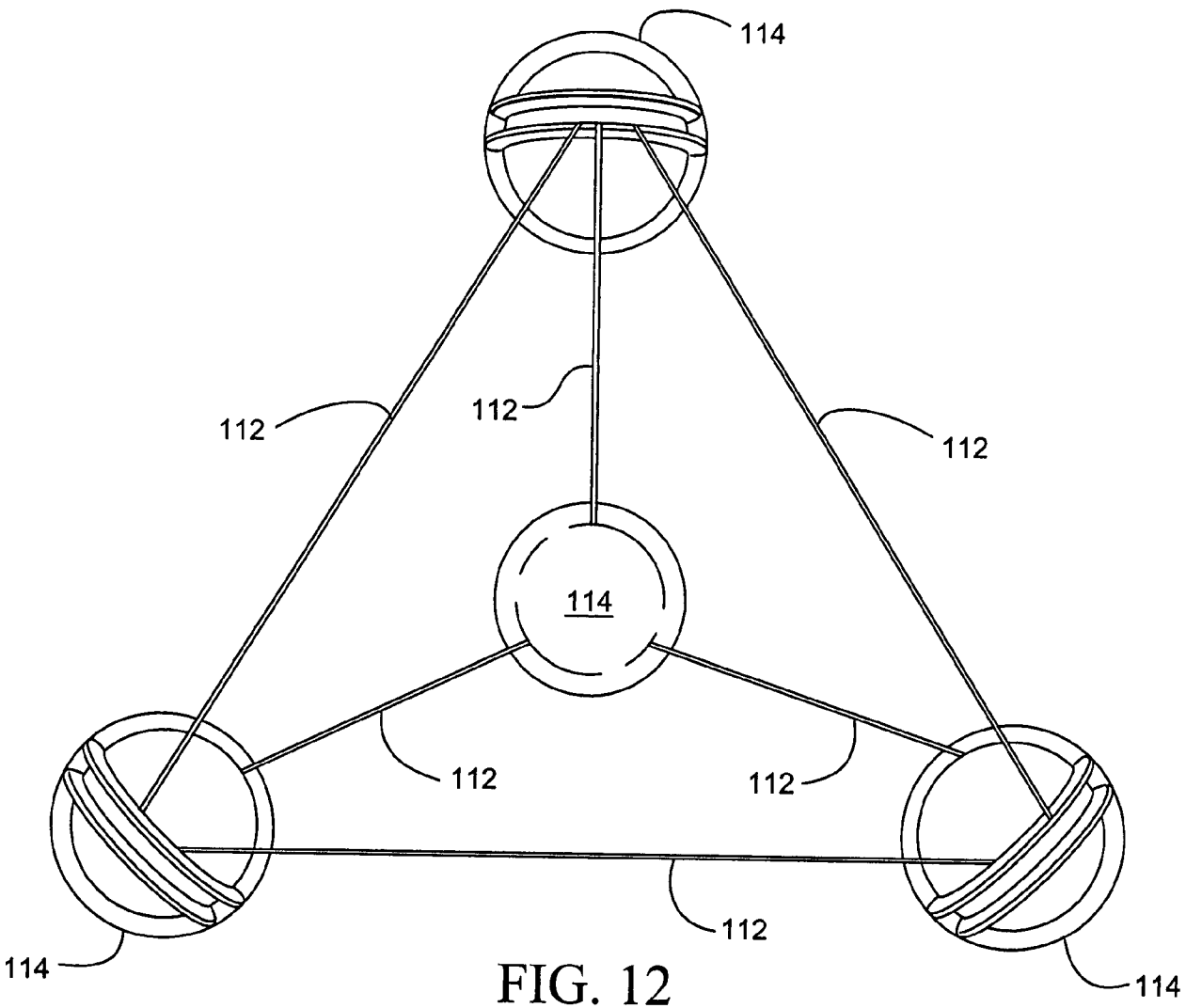
FIG. 12 is a perspective view of a tetrahedron-shaped electronic throw-and-catch game with four grip areas according to a fourth additional embodiment of the invention.

In FIG. 12, a tetrahedron-shaped housing 112 provides four grip areas 114 according to a fourth additional embodiment of the invention. As can be easily understood, other open geometric shapes are equally applicable to this embodiment.

Figure 13:
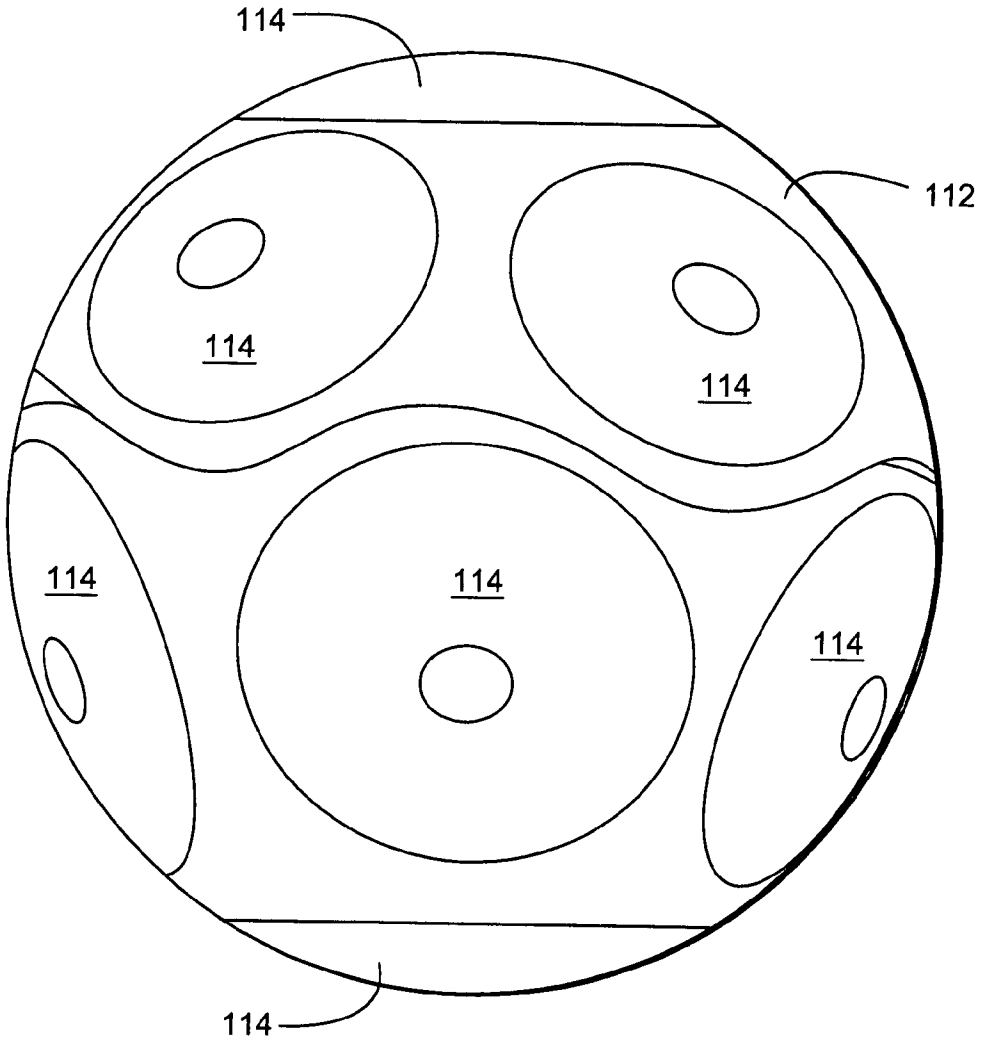
FIG. 13 is a perspective view of a sphere-shaped electronic throw-and-catch game with twelve grip areas according to a fifth additional embodiment of the invention.

In FIG. 13, a sphere-shaped housing 112 provides ten grip areas 114 according to a fifth additional embodiment of the invention. As can be easily understood, a range of the number of grip areas 114 exists depending on the desired diameter of the housing 112, the desired diameter of the grip area 114, and the desired spacing between grip areas 114. It is understood that other generally spherical or ovoid shapes, including football shaped, are equally applicable to this embodiment. It is still further understood that grip areas 114 may be of variable size and shape.

Figure 14:
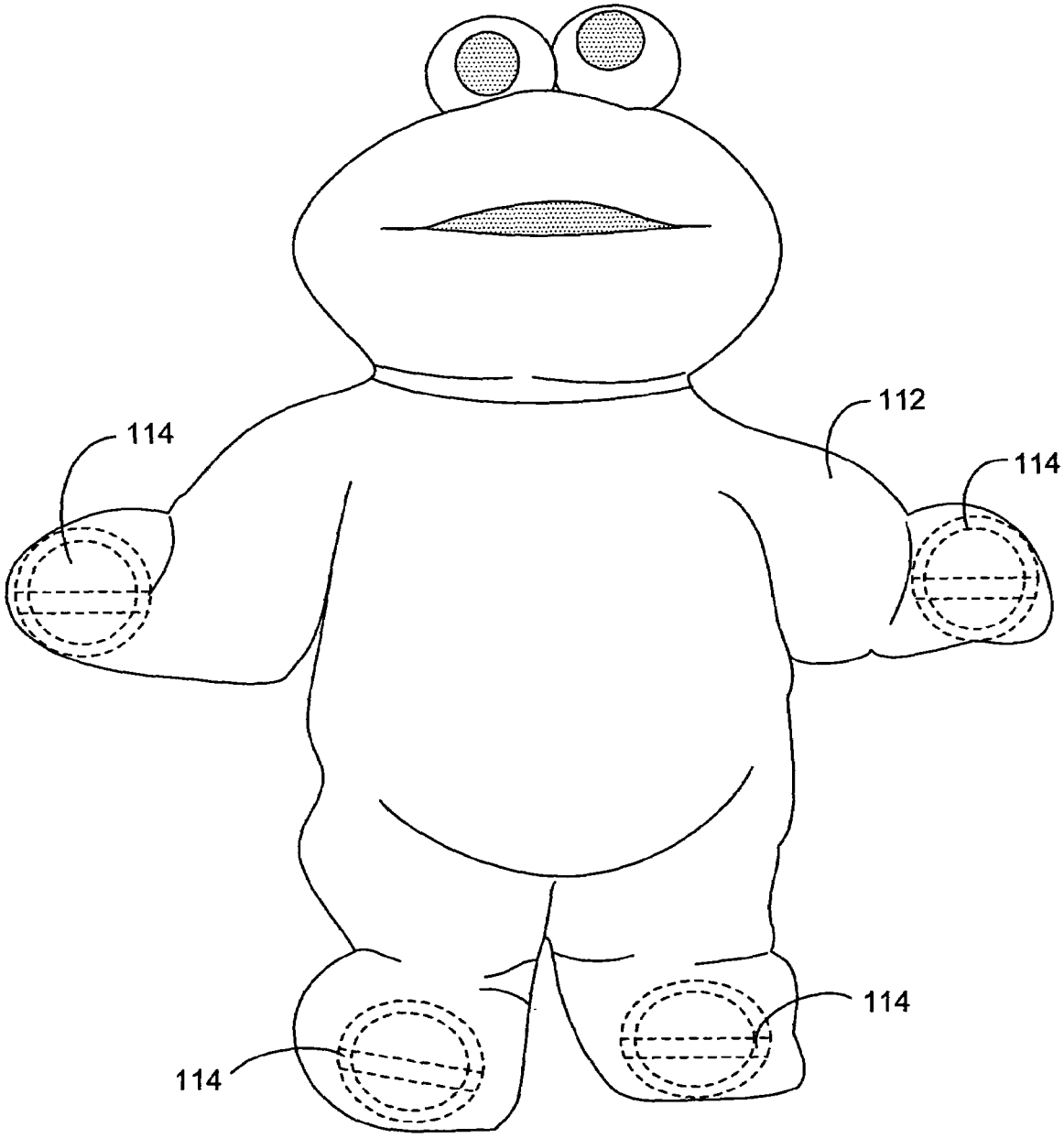
FIG. 14 is a perspective view of a character-shaped electronic throw-and-catch game with four grip areas according to a sixth additional embodiment of the invention.

In FIG. 14, a character-shaped housing 112 provides four grip areas 114 according to a sixth additional embodiment of the invention. As can be easily understood, a wide range of character configurations and numbers of grip areas 114 may be accommodated.

When a more complicated gameplay is desired, a wider range of grip patterns and catch combinations is needed.

One technique that is familiar to those skilled in the art is the use of two or more colors to indicate different actions during gameplay. For example, game rules can define that if an indicator 218 is green that the corresponding grip area 114 should be touched and if an indicator 218 is red that the corresponding grip area 114 should not be touched. Various color combinations may be used to implement expanded game logic.

Another method of adding additional game complexity is to increase the delay between the throw and when the grip pattern is displayed on the indicators 218. This reduces the preparation time available for the catch.

Still another alternative embodiment is to momentarily display a fictitious grip pattern on the indicators 218 at the throw, followed by the real grip pattern soon after. This both reduces the preparation time available for the catch and causes potential confusion for the player.

Still another alternative embodiment is to differentiate grip areas 114 by color, design, or shape, and to present the desired grip pattern audibly. Voice calls, such as "red and blue" can be used to indicate which touch sensors 234 are to be activated. Distinct designs, such as a representation of a cat, dog, and horse, for example, may be audibly presented with corresponding sound effects ("meow", "woof", and "whinny"). Grip areas 114 with size (small, medium, and large) or geometric shape (square, triangle, and circle) differentiation also serve this function. Representations of well known characters (Cookie Monster, Big Bird, Elmo characters from Sesame Street, for example) may be presented by playing signature phrases in their own voice.

Still another alternative embodiment is to have game rules that require throws and catches with a particular orientation or motion. For example, a throw with added difficulty may involve a 180 degree or 360 degree end-to-end flip. Another variation is to impart an axial rotation during the throw, again causing a more difficult resulting catch. A catch with added difficulty could require that the stick design of the preferred embodiment must be orientated vertically immediately after the catch. Various well-know sensors technologies, including mechanical tilt switches, mercury switches, potentiometers with offset weights, liquid tilt sensors, and accelerometers may be used to confirm that the requested catch has been successfully completed.

Figure 15:
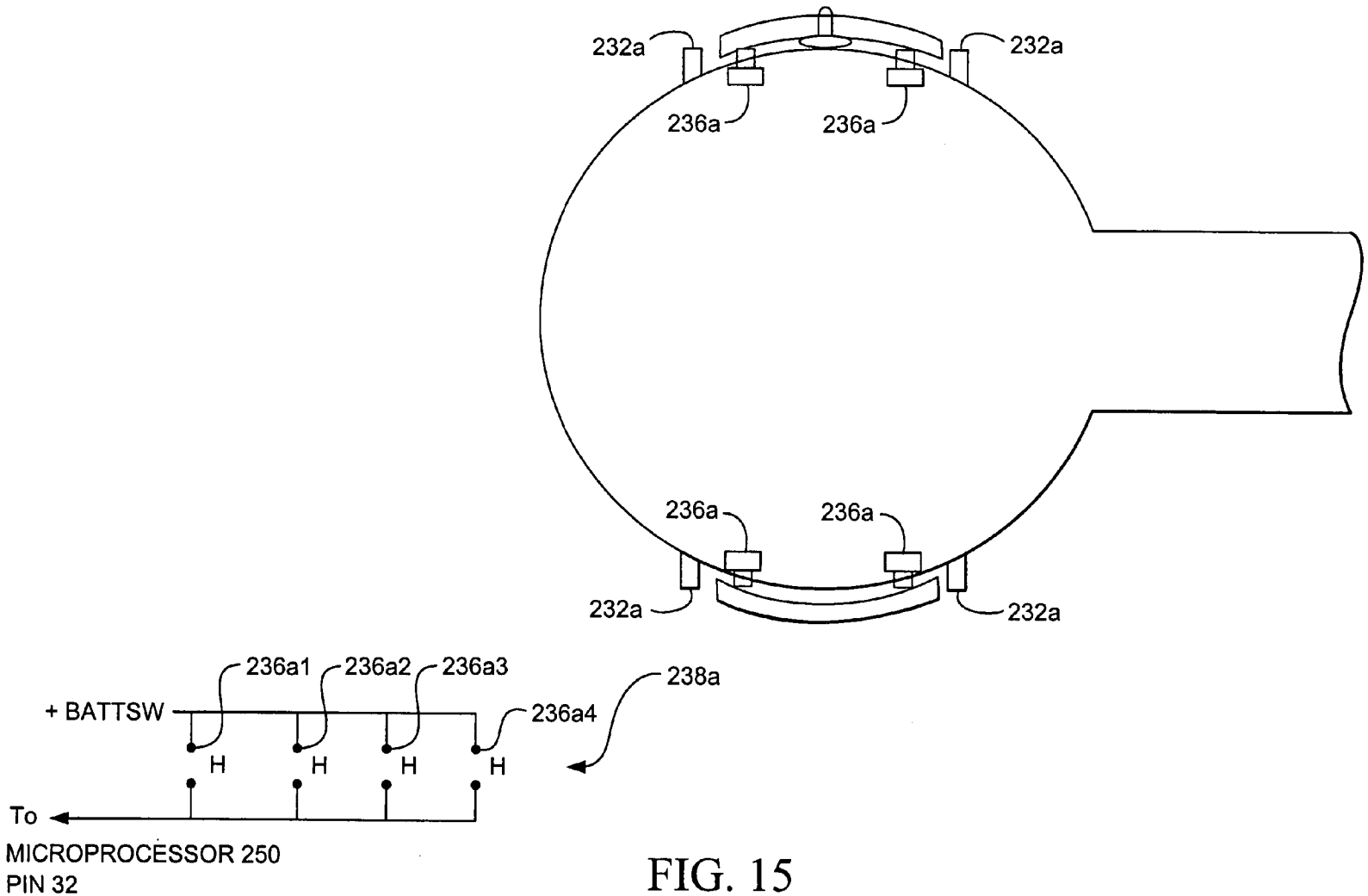
FIG. 15 is a partial cross sectional view of an alternative grip area embodiment that provides both touch sensing and squeeze sensing.

One method of expanding the number of catch combinations for a given number of grip areas 114 is to add a squeeze sensor 238 to the existing grip touch sensor 234. In FIG. 15, an alternative embodiment of grip area **114*a* is illustrated that adds squeeze switches 236*a*1 through 236*a*4. When directed by the game rules, the player is required to squeeze the grip area 114 instead of just grasping it lightly. In FIG. 15**, four switches are depicted to provide full coverage of the grip area, although a fewer or greater number may be desired depending on the grip design. It is also contemplated in an alternative embodiment that the squeeze sensors replace the touch sensors altogether so that catching is sensed completely by pressure instead of touch.

In a further still embodiment (not shown), the device 100 may be generally in the form of a Frisbee® disc, football or glider imbedded with grip areas 114 and LEDs on perimeter or other locations. This embodiment is designed to allow long distance throwing and catching of the device 100.

For example, where the device is configured as a Frisbee® disc, the game could include 1-handed catch instruction on the Frisbee® disc, indicated by visual persistence effect showing geographic pie pieces created with an array of LEDs. Alternatively, a separate static attached housing could be provided that doesn't spin with the outer housing, with LEDs located around its circumference.

Where the device 100 is configured as a football, the game could include 1 or 2 handed instruction on football indicated by LEDs lit on nose, middle or back of football style housing Where the device 100 is configured as a glider, the game could include 1-handed catch instruction on glider type housing indicated by LED lit on either tail or left or right wing or nose.

In a further alternative embodiment (not shown), the housing 112 of device 100 could be made of a soft, flexible material and include an elastic endoskeletal frame, made of wire or spring material. The device could further include a pair of balls located at the ends of the frame. The flexible housing and elastic endoskeletal frame could allow the device varied and unpredictable movement of the outer balls on each throw.

In the above description, microprocessor 250 and the associated circuitry is indicated to be housed within housing 112. In an alternative embodiment, the microprocessor 250 may be located in a base, remote from the housing. In this embodiment, control signals from the microprocessor could be relayed wirelessly to the touch sensors 234 on the device. Similarly, feedback from the touch sensors 234 could be related wirelessly to the microcontroller. As would be appreciated by those of skill in the art, transceivers can be located in the base and housing 112 to transmit and receive the signals between the microprocessor and touch sensors, for example via RF or IR transmission.

Although the invention has been described in detail herein, it should be understood that the invention is not limited to the embodiments herein disclosed. Various changes, substitutions and modifications may be made to the disclosure by those skilled in the art without departing from the spirit or scope of the invention as described and defined by the appended claims.

What is claimed is:

1. A catch-and-throw game, comprising: a housing; one or more grip areas along said housing capable of being gripped; one or more sensors in said housing and associated with said one or more grip areas for sensing when said one or more grip areas is gripped; one or more indicators in said housing for perceivably indicating one or more of said one or more grip areas; and a microprocessor for selecting one or more of said indicators to perceivably indicate one or more of said one or more grip areas after detecting said housing has been thrown, for receiving feedback from said one or more sensors relating to which of said one or more grip areas is gripped, and for perceivably indicating whether said one or more grip areas that is gripped corresponds to said one or more grip areas that is indicated.

2. A catch-and-throw game as recited in claim 1, wherein said housing is substantially tubular and one of a single axis, two axis and three axis configuration.

3. A catch-and-throw game as recited in claim 1, wherein said one or more grip areas comprise three grip areas.

4. A catch-and-throw game as recited in claim 1, wherein said one or more sensors are capable of sensing electrical conductivity.

5. A catch-and-throw game as recited in claim 1, wherein said one or more sensors are one of capacitive sensors, electric field sensors, optical sensors, and actuation force switches.

6. A catch-and-throw game as recited in claim 1, wherein one of said one or more indicators is located at each of said one or more grip areas.

7. A catch-and-throw game as recited in claim 6, wherein said one or more indicators visibly indicate one or more of said one or more grip areas.

8. A catch-and-throw game as recited in claim 7, wherein said one or more indicators are light emitting diodes.

9. A catch-and-throw game as recited in claim 1, wherein said microprocessor is further capable of varying the number and/or location of said one or more grip areas indicated by said one or more indicators between a first time when said one or more grip areas are gripped and a second time when said one or more grip areas are gripped.

10. A catch-and-throw game as recited in claim 1, further comprising a switch for allowing selection of varying complexity levels with which the number and/or location of said one or more grip areas are indicated by said one or more indicators.

11. A catch-and-throw game as recited in claim 1, wherein said microprocessor is located within said housing.

12. A catch-and-throw game as recited in claim 1, wherein said microprocessor is located remotely from said housing and signals are transferred between said microprocessor and said one or more indicators and sensors via wireless protocols.

13. A method of playing a catch-and-throw game, the game including a device having a housing, grip areas along the housing and indicators associated with the grip areas, the method comprising the steps of: (a) throwing the device in the air; (b) indicating one or more of the grip areas by the indicators; (c) attempting to catch the device at the one or more grip areas indicated in said step (b); and (d) indicating whether the device was caught at the one or more grip areas indicated in said step (b).

14. A method of playing a catch-and-throw game as recited in claim 13, further comprising step (e) of repeating said steps (a) through (d) until said step (d) indicates that the device was not caught at the one or more grip areas indicated in said step (b).

15. A method of playing a catch-and-throw game as recited in claim 14, further comprising step (f) of varying the pattern of the one or more grip areas indicated in said step (b) upon repetition in said step (e).

16. A method of playing a catch-and-throw game as recited in claim 14, further comprising step (f) of varying the complexity of the pattern of the one or more grip areas indicated in said step (b) upon repetition in said step (e).

17. A method of playing a catch-and-throw game as recited in claim 13, the grip areas including a left grip area, a center grip area and a right grip area, wherein said step (b) of indicating one or more of the grip areas by the indicators comprises indicating one of: (i) the left grip area, (ii) the right grip area, (iii) the center grip area, (iv) the left grip area and center grip area, (v) the center grip area and right grip area, (vi) the left grip area and right grip area, (vii) the left grip area, the center grip area and the right grip area.

18. A method of playing a catch-and-throw game as recited in claim 17, wherein said step (b) of indicating one or more of the grip areas by the indicators comprises the step of illuminating at least a portion of the indicated grip area.

19. A method of playing a catch-and-throw game, the game including a device having a housing, grip areas along the housing, sensors associated with the grip areas, indicators associated with the grip areas, a microprocessor and switches for determining the game mode, the method comprising the steps of: (a) selecting a game mode via one or more of the switches; (b) monitoring the sensors after said step (a) to determine if the device is being held; (c) selecting a pattern of grip areas to be indicated by the indicators if it is determined in said step (b) that the device is not being held; (d) indicating the pattern of grip areas selected in said step (c) by the indicators; (e) receiving feedback from the sensors to determine which grip areas are being held after said steps (c) and (d); (f) comparing which grip areas are held against which grip areas were indicated by the indicators; (g) providing a first perceivable feedback if the grip areas held in said step (f) match the pattern of grip areas selected in said step (c); and (h) providing a second perceivable feedback, different than the first perceivable feedback, if the grip areas held in said step (f) do not match the pattern of grip areas selected in said step (c).

20. A method of playing a catch-and-throw game as recited in claim 19, further comprising step (i) of repeating said steps (b) through (h) if the comparison of said step (f) indicates the grip areas held match the pattern of grip areas selected.

21. A method of playing a catch-and-throw game as recited in claim 20, further comprising step ( ) of varying the pattern of the one or more grip areas selected in said step (c) upon repetition of said steps (b) through (h) in said step (i).

22. A method of playing a catch-and-throw game as recited in claim 20, further comprising step o) of varying the complexity of the pattern of the one or more grip areas selected in said step (c) upon repetition of said steps (b) through (h) in said step (i).

23. A method of playing a catch-and-throw game as recited in claim 19, the grip areas including a left grip area, a center-grip area and a right grip area, wherein said step (c) of selecting one or more of the grip areas by the indicators comprises selecting one of: (i) the left grip area, (ii) the right grip area, (iii) the center grip area, (iv) the left grip area and center grip area, (v) the center grip area and right grip area, (vi) the left grip area and right grip area, (vii) the left grip area, the center grip area and the right grip area.

24. A method of playing a catch-and-throw game as recited in claim 19, wherein said step (d) of indicating one or more of the grip areas by the indicators comprises the step of illuminating at least a portion of the indicated grip area.

25. An apparatus, comprising:

a tossable housing, said housing defining a catch system, said catch system including one or more catch regions;

a sensor system, coupled to said housing and coupled to said catch system, said sensor system detecting a catch status of said catch system;

an indicator system, coupled to said housing, for indicating a catch pattern, said catch pattern identifying one or more of said one or more catch regions; and a processor system, communicated to said sensor system and communicated to said indicator system, for determining a toss-state for said housing and for generating said catch pattern by said indicator system when said toss-state has a predetermined value indicating said housing has been tossed, and said processor system for determining a conformance between said catch status and said catch pattern after said toss-state indicates said housing has been caught.

26. The apparatus of claim 25 wherein said housing includes an arrangement of members directed outward from a center node, each said member terminating at one of said catch regions.

27. The apparatus of claim 25 wherein said housing includes an object having a plurality of vertices each terminating generally at one of said catch regions.

28. The apparatus of claim 25 wherein said toss state is determined responsive to a catch status of said one or more catch regions.

29. The apparatus of claim 25 wherein said indicator system includes a plurality of illumination members, at least one illumination member associated with each catch region, said plurality of illumination members collectively defining said catch pattern.

30. The apparatus of claim 25 wherein said processor system varies said catch pattern responsive to a history of a degree of conformance between said catch pattern and catch status of previous tosses and corresponding catches.

31. The apparatus of claim 30 wherein said catch pattern variation increases a difficulty of catch patterns responsive to said history indicating a number of successful successive tosses and catches.

32. A method, the method comprising:

a) tossing a housing, said housing defining a catch system, said catch system including one or more catch regions wherein said housing includes a sensor system coupled to said catch system for detecting a catch status of said catch system and wherein said housing includes an indicator system for indicating a catch pattern, said catch pattern identifying one or more of said one or more catch regions;

b) determining a toss-state for said housing;

c) generating said catch pattern by said indicator system when said toss-state has a predetermined value indicating said housing has been tossed, and d) determining a conformance between said catch status and said catch pattern after said toss-state indicates said housing has been caught.

* * * * *